United States Patent [19]

Mills

[11] Patent Number: 4,476,825

[45] Date of Patent: Oct. 16, 1984

[54] ENGINE PROTECTIVE APPARATUS WITH REMOTE OVERRIDE

[75] Inventor: J. T. Mills, Houston, Tex.

[73] Assignee: Sentinel Manufacturing Company, Inc., Denver, Colo.

[21] Appl. No.: 501,828

[22] Filed: Jun. 7, 1983

Related U.S. Application Data

[63] Continuation-in-part of Ser. No. 296,193, Aug. 25, 1981, Pat. No. 4,399,785.

[51] Int. Cl.[3] ..... F02B 77/08

[52] U.S. Cl. ..... 123/198 DB; 123/198 D; 123/196 S

[58] Field of Search ..... 123/198 DB, 198 D, 196 S

[56] References Cited

U.S. PATENT DOCUMENTS

| | | | |
|---|---|---|---|
| 3,148,671 | 9/1964 | Bozzorff et al. | 123/198 DB |
| 3,153,403 | 10/1964 | Dobbs | 123/198 DB |
| 3,202,143 | 8/1965 | Goodwin | 123/41.15 |
| 3,202,161 | 8/1965 | Richards | 123/198 D |
| 3,492,983 | 2/1970 | Vipperman | 123/198 DB |
| 3,523,521 | 8/1970 | Goodwin | 123/198 DB |
| 3,533,390 | 10/1970 | Goodwin | 123/198 DB |
| 3,590,798 | 7/1971 | Goodwin | 123/198 D |
| 3,626,920 | 12/1971 | Maher | 123/198 DB |
| 3,877,455 | 10/1975 | Goodwin | 123/198 D |
| 4,067,348 | 1/1978 | Davis | 123/198 DB |
| 4,080,946 | 3/1978 | Cunningham | 123/198 DB |
| 4,106,468 | 8/1978 | Davis | 123/198 DB |
| 4,117,822 | 10/1978 | Mills | 123/198 DB |
| 4,202,513 | 5/1980 | Bilbrey et al. | 123/198 DB |
| 4,329,954 | 5/1982 | Dobbs | 123/198 DB |
| 4,338,896 | 7/1982 | Papasideris | 123/198 DB |

FOREIGN PATENT DOCUMENTS

| | | |
|---|---|---|
| 560498 | 4/1944 | United Kingdom . |
| 1416473 | 12/1975 | United Kingdom . |

*Primary Examiner*—Ira S. Lazarus

*Attorney, Agent, or Firm*—Kerkam, Stowell, Kondracki & Clarke

[57] ABSTRACT

An engine device that is responsive to low oil pressure to cut off or limit fuel flow to avoid or minimize the chance of engine damage. A spring-biased elongate main valve member includes an axial bore and an override spring-biased ball valve to selectively allow fuel flow through said axial bore. A remote override function is realized by use of a bypass valve controlled by a pneumatic or electrical switch. One embodiment of the remote override uses a pushbutton and a spring-biased hydraulic piston to actuate the bypass valve which allows fuel around the main fuel member. An override lock prevents a mechanical, local (i.e., not remote) override from being changed from an override position back to a normal or off position in the event of insufficient oil pressure.

21 Claims, 12 Drawing Figures

MAIN VALVE CLOSED
OVERRIDE VALVE OPEN

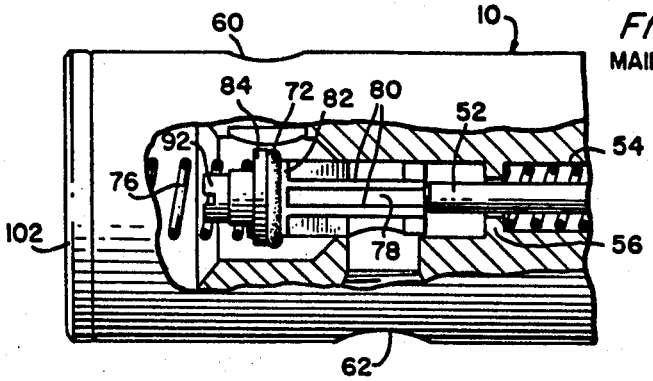
FIG. 4.
MAIN VALVE OPEN
FIG. 5.
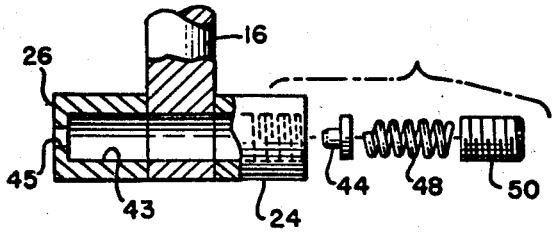
FIG. 7.
OVERRIDE VALVE CLOSED
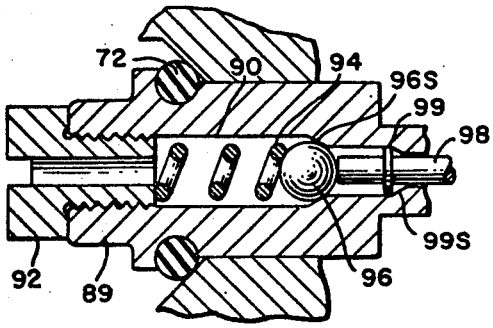
FIG. 6.
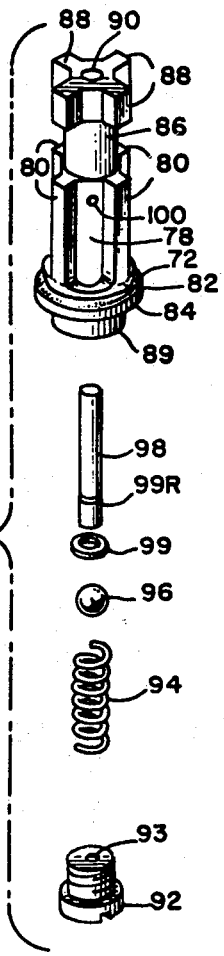

ENGINE PROTECTIVE APPARATUS WITH REMOTE OVERRIDE

CROSS-REFERENCE TO RELATED APPLICATIONS

This application is a continuation-in-part of my previous U.S. patent application entitled "ENGINE PROTECTIVE DEVICE RESPONSIVE TO LOW OIL PRESSURE" filed Aug. 25, 1981, Ser. No. 296,193, now U.S. Pat. No. 4,399,785.

TECHNICAL FIELD

This invention relates to safety devices for controlling the flow of fuel to internal combustion engines so as to protect an engine against damage due to insufficient oil pressure in the lubricating system thereof.

BACKGROUND

There are in the prior art a number of engine protective devices which shut off or greatly reduce the flow of fuel to the engine in the event of inadequate lubricating oil pressure. The following Patents assigned to the Assignee of the present invention, and hereby incorporated by reference, disclose such prior art devices:

| U.S. Pat. No. | Inventor | Dated |
|---|---|---|
| 3,202,143 | Goodwin | Aug. 24, 1965 |
| 3,523,521 | Goodwin | Aug. 11, 1970 |
| 3,590,798 | Goodwin | July 6, 1971 |
| 4,117,822 | Mills | Oct. 3, 1978 |

The device of U.S. Pat. No. 3,202,143 is a full fuel shut off valve effecting an automatic full shut down of the engine when the oil pressure drops below a predetermined value or the engine overheats. This device also includes a manually operable override which, when operated, will allow sufficient fuel to reach the engine to produce maximum power and speed even though the engine pressure has dropped below normal, or the engine has overheated, with possible consequent damage to the engine.

U.S. Pat. No. 3,523,521 discloses an engine safety device responsive to abnormal oil pressure conditions. The device includes means for varying the oil pressure level at which the fuel valve is shut off dependent on variations in the pressure of the fuel being supplied to the engine.

U.S. Pat. No. 3,590,798 also discloses an engine safety device responsive to abnormal oil pressure and coolant temperature conditions. However, unlike the two patented inventions discussed immediately above, this device is not a full fuel shut off effecting a full shut down of the engine. Instead, it is an automatic engine decelerating or detorquing valve by virtue of a built in fuel bypass which continues to supply the engine with a restricted quantity of fuel after the main fuel valve is closed. It also includes a manually operated override which, when operated, permits operation of the engine at maximum power and speed in like fashion to the above-described device of U.S. Pat. No. 3,202,143.

U.S. Pat. No. 4,117,822 discloses a safety device which effects a full shutdown of the engine when abnormally low oil pressure conditions arise. A manually operated override is included whereby a restricted amount of fuel sufficient only to run the engine at a reduced power and at reduced speed is supplied to the engine.

Although the devices of the prior art have been quite useful in preventing various engine damage, they have been subject to a number of undesirable limitations.

One limitation of the prior art devices, is the inability of the engine owner to determine whether the engine operator has overriden the fuel shut off valve. In particular, the prior art devices lack a means whereby the engine owner can determine whether the operator has overriden the emergency shut down. For these prior art devices, the operator may run the engine for long periods of time after actuating the override option, thereby causing severe damage to the engine. After such excessive engine damage has been caused, an unscrupulous operator may simply return the override control knob to the run position and deny having actuated the override. Due to the high cost of diesel engine repairs, engine owners are most desirous of minimizing override abuse by the operators after an emergency shut down.

A further problem with the prior art devices is the need to obtain access to the engine in order to override the engine protective shut off of the fuel flow. For certain engines it may be necessary to actuate the override for starting purposes because the fuel downstream from the fuel valve is not adequate to keep the engine going long enough to build up the oil pressure sufficiently to open the fuel valve. It is most inconvenient to have to obtain access to the engine to actuate the override for starting purposes.

A further deficiency in the prior art devices is the inability to conveniently and securely change from a detorque mode of operation (wherein failure of oil pressure causes a restricted amount of fuel flow) to a shut down mode of operation (wherein loss of oil pressure causes complete fuel cut off). Although the above-discussed U.S. Pat. No. 3,590,798 does disclose a device which may be changed from a detorque mode to a full shut down mode this change of modes may be accomplished simply by adjusting an externally accessible set screw 106. Accordingly, the operator of the engine may use such a set screw to defeat the engine owners command that the device be operated in the full shut down mode.

Although the above-mentioned U.S. Pat. No. 4,117,822 discloses a engine protective device with a restricted override, the restricted override has required mechanisms substantially different from the handle 50 and the cam 43 of such patents as U.S. Pat. Nos. 3,202,143 and 3,590,798. It would be most useful if an arrangement could be found, wherein a handle and cam such as in U.S. Pat. Nos. 3,202,143 and 3,590,798 controlled the operation of a restricted override.

U.S. patent application Ser. No. 296,193, which is the parent application to the present application, discloses a system which overcomes or minimizes these problems. However, the remote override arrangements disclosed in this parent patent application have several disadvantages.

The system in the parent application discloses an electrical override system which is readily adaptable to those engines which use battery or electric starting. However, there are a substantial number of engines for which the electrical override system is not especially well-suited.

The alternate pneumatic override disclosed in the parent application is quite useful in numerous applications. However, it is not always desirable or possible to use a pneumatic source for supplying pneumatic pressure.

If the engine protective system was installed on a vehicle with air brakes, one could "tap-in" on the pressurized air in the air brake system. Obviously, the tapping-in to use the same pressurized air for the engine protective valving apparatus as used for the brakes would have to be done very carefully. Air leaks in the system might disable the vehicle's brakes.

An engine driven air compressor could be used as a pneumatic source, but an engine is usually shut-down for hours at a time. The engine driven air compressor and the air supply or holding tanks may lose their pressure. Further, the operator may manually exhaust the air supply to avoid condensation. On those engines where the remote override must be initially operated to start the engine, the lack of air pressure would prevent the starting of the engine by an engine driven air supply.

The use of an air source not powered by the brakes or motor could avoid these disadvantages of a pneumatic override. However, this would add considerably to the complexity and cost of the system.

BRIEF SUMMARY OF THE INVENTION

It is a primary object of the present invention to provide a new and improved engine protective system.

A further object of the present invention is to provide a remotely actuated non-electrical, simple and reliable override function for a fuel cut off device.

A further object of the present invention is to provide an engine safety device having options whereby loss of oil pressure may selectively cause either engine shut down or limited torque.

A still further object of the present invention is to provide a restricted fuel manual override wherein the same push rod used as a main valve operator is activated by a handle and cam arrangement in order to provide a restricted fuel manual override.

These and other objects of the present invention which will be apparent as the description proceeds are realized by an apparatus for controlling the flow of fuel in a fuel supply line of an internal combustion engine in response to pressure in the engine's lubricating system and comprising: a main body having a main fuel passageway therein; a fuel inlet port and a fuel outlet port, each port communicating with the main fuel passageway and adapted to be connected to the fuel supply line of a internal combustion engine; a lubricant pressure sensor for sensing the pressure in the engine's lubricating system; a main valve in the main fuel passageway for controlling the normal flow of fuel between the fuel inlet port and the fuel outlet port, the main valve closing when the lubricant pressure sensor indicates that the pressure in the engine's lubricating system is below a predetermined value P1; a bypass fuel passage way in the body, bypassing that portion of the main fuel passageway controlled by the main valve, and operable to allow a predetermined restricted amount of fuel from the fuel inlet port to the fuel outlet port; a normally closed bypass valve selectively blocking the bypass fuel passage way; and a bypass valve actuator remote from the main body and controlling the bypass valve by a pressurized fluid control line; and wherein the bypass fuel passage way is at least partly outside of boundaries which define the main fuel passageway. An override actuator is mounted on the main body at least partly externally to the main body and is selectively disposable in an off state and in override state, the override state allowing fuel flow from the fuel inlet port to the fuel outlet port even if the pressure in the engine lubricating system is below the predetermined value P1. The bypass valve actuator includes a spring biased actuating piston operable to place fluid in the control line under pressure. The bypass valve is operated by a spring-biased bypass piston disposed at least partly outside of the main body and the actuating piston is operable to open the bypass valve by moving the bypass piston. The bypass piston is rigidly connected to the bypass valve. The bypass valve actuator includes a manually operable push button and the bypass valve will be open only as long as the push button is pressed. Alternately, the bypass valve actuator includes a manually operable push button and means for locking the push button in on position corresponding to the bypass valve being open. The push button is mounted on a shaft disposed partly within a sleeve and the means for locking includes a locking pin on the shaft and a locking notch in the sleeve for receiving the locking pin and locking the push button in an on position.

The present invention may alternately be described as an apparatus for controlling the flow of fuel in a fuel supply line of an internal combustion engine in response to pressure in the engine lubricating system comprising: a main body having a main fuel passageway therein; a fuel inlet port and a fuel outlet port, each port communicating with the main fuel passageway and adapted to be connected to the fuel supply line of an internal combustion engine; a lubricant pressure sensor for sensing the pressure in the engine lubricating system; a main valve in the main fuel passageway for controlling the normal flow of fuel between the fuel inlet port and the fuel outlet port, the main valve closing when the lubricant pressure sensor indicates that the pressure in the engine's lubricating system is below a predetermined value P1; a bypass fuel passageway in the main body, bypassing that portion of the main fuel passageway controlled by the main valve, to allow a predetermined restricted amount of fuel from the fuel inlet port to the fuel outlet port; a normally closed bypass valve selectively blocking the bypass fuel passageway; and a bypass valve actuator remote from the main body and controlling the bypass valve by a pressurized fluid control line. The bypass valve actuator includes a spring-biased actuating piston operable to place fluid in the control line under pressure. The bypass valve actuator affects the internal combustion engine only by operation of the bypass valve, and the bypass valve is the only mechanism controlled by the pressurized fluid control line. A pressure responsive bypass surface is rigidly connected to the bypass valve and in contact with pressurized fluid from the control line. More specifically, the pressure responsive bypass surface is on a bypass piston rigidly fixed to the bypass valve. The bypass surface is external to the main body.

The present invention may alternately be described as an apparatus for controlling the flow of fuel in a fuel supply line of an internal combustion engine in response to pressure from the engine's lubricating system comprising: a main body having a main fuel passageway therein; a fuel inlet port and a fuel outlet port, each port communicating with the main fuel passageway and adapted to be connected to the fuel supply line of an internal combustion engine; a lubricant pressure sensor for sensing the pressure in the engine's lubricating system; a main valve in the main fuel passageway for controlling the normal flow of fuel between the fuel inlet port and the fuel outlet port, the main valve closing when the lubricant pressure sensor indicates that the pressure in the engine's lubricating system is below a predetermined value P1; a bypass fuel passageway in said main body, bypassing that portion of the main fuel passageway controlled by the main valve, to allow a predetermined restricted amount of fuel to flow from the fuel inlet port to the fuel outlet port; a normally closed bypass valve selectively blocking the bypass fuel passageway; and, a bypass valve actuator remote from the main body and controlling the bypass valve by a control line; and wherein the bypass valve is part of a remote override assembly removably mounted to the main body and having a portion external to the main body. The apparatus further comprises an override lock operable to prevent the changing of the override actuator from the override state to the off state if the pressure in the engine's lubricating system is below a predetermined value P2.

The present invention may alternately be described as an apparatus for controlling the flow of fuel in a fuel supply line of an internal combustion engine in response to pressure from the engine's lubricating system comprising: a main body having a main fuel passageway therein; a fuel inlet port and a fuel outlet port, each port communicating with the passageway and adapted to be connected to the fuel supply line of an internal combustion engine; a lubricant pressure sensor for sensing the pressure in the engine's lubricating system; a main valve in the main fuel passageway for controlling the normal flow of fuel between the fuel inlet port and the fuel outlet port, the main valve closing when the lubricant pressure sensor indicates that the pressure in the engine's lubricating system is below a predetermined value P1, the main valve includes an elongate movable main valve member which is spring biased by a main valve spring to be normally closed, the main valve member includes a bore therein, the bore having a bore inlet in communication with the fuel inlet port and a bore outlet in communication with the fuel outlet port such that fuel may flow through the bore from the fuel inlet port to the fuel outlet port; an override push rod disposed at least partially in the bore; and an override actuator selectively disposable in an off state and an override state, the override state allowing fuel flow in the fuel supply line of the engine even if pressure in the engine's lubricating system is below the predetermined value P1; and wherein the override actuator is operable in its override state to allow fuel flow from the bore inlet to the bore outlet by moving the override push rod away from the lubricant pressure sensor. The override actuator is mounted on the main body externally thereto. A spring-biased ball valve is disposed inside of the main valve member to selectively block the bore.

The present invention may alternately be described as an apparatus for controlling the flow of fuel in a fuel supply line on an internal combustion engine in response to pressure in the engine's lubricating sytem, comprising: a main body having a main fuel passageway therein; a fuel inlet port and a fuel outlet port, each port communicating with the main fuel passageway and adapted to be connected to the fuel supply line of an internal combustion engine; a lubricant pressure sensor for sensing the pressure in the engine's lubricating system; a main valve in the main fuel passageway for controlling the normal flow of fuel between the fuel inlet port and the fuel outlet port, the main valve closing when the lubricant pressure sensor indicates that the pressure in the engine's lubricating system is below a predetermined value P1, the main valve includes an elongate movable main valve member which is spring biased by a main valve spring to be normally closed, the main valve member including a bore therein, the bore having a bore inlet in communication with the fuel inlet port and a bore outlet in communication with the fuel outlet port such that fuel may flow through the bore from the fuel inlet port to the fuel outlet port; an override valve disposed in the bore; an override spring disposed at least partially within the main valve member and biasing the override valve; and an override actuator selectively disposable in an off state and an override state, the override state allowing fuel flow in the fuel supply line of an engine even if the pressure in the engine's lubricating system is below the predetermined value P1; and wherein the override actuator is operable in its override state to allow fuel flow from the bore inlet to the bore outlet by moving the override valve against the bias of the override spring. The override valve is a ball valve within the bore.

BRIEF DESCRIPTION OF THE DRAWINGS

These and other features of the present invention and the advantages will be readily apparent to those having ordinary skill in the art and the invention will be more easily understood from the following detailed description of the preferred embodiments of the present invention taken in conjunction with the accompanying drawings wherein like references characters represent like parts throughout several views.

FIG. 4 is a partial cross-section in the same plane as FIG. 3 with the main valve in the open position.

FIG. 5 is a side view of the cam of the present invention.

FIG. 6 is an exploded perspective of several of the parts of the main valve of the present invention.

FIG. 7 is an enlarged cross section of one end of the main valve member of the present invention.

DETAILED DESCRIPTION OF THE INVENTION

Figure 1:
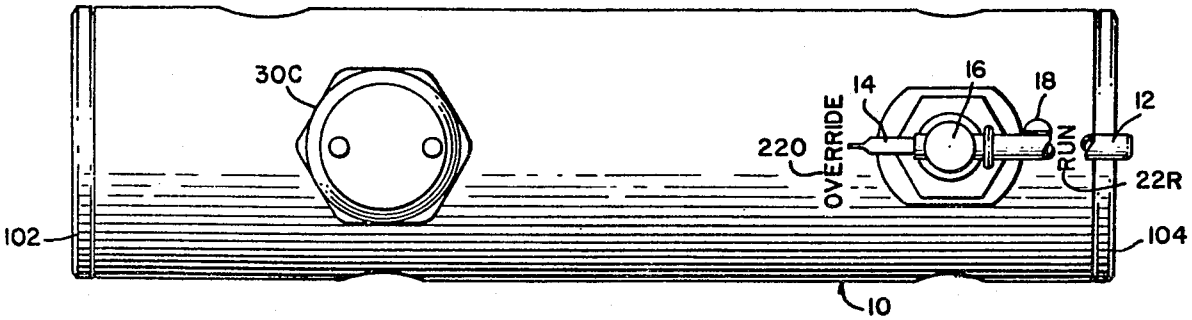
FIG. 1 is a top view of parts of the present invention.

Referring now to FIG. 1, there is shown a top view of the present invention. Specifically, body 10 is generally cylindrical and includes at one end an operating handle 12 which turns a shaft 16 and associated limit pin 14. In addition to indicating whether the manual override is in an override state or a run state by virtue of the indicia 220 or 22R, limit pin 14 cooperates with stop pin 18 to prevent operating handle 12 and associated shaft 16 from turning more than 180° as described in more detail in U.S. Pat. No. 3,202,143. Handle 12, mounted to said body 10 externally thereto, functions as an override actuator. A remote override cap 30C, the details of which will be discussed later with reference to FIG. 5, is also shown in FIG. 1.

Figure 2:
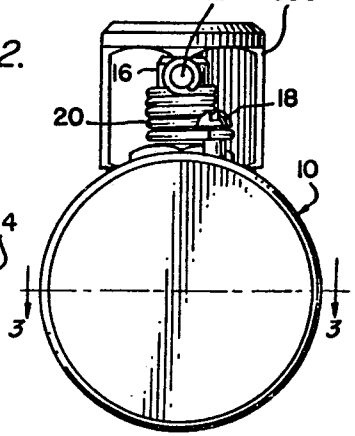
FIG. 2 is an end view of parts of the present invention.

FIG. 2 is an end view showing the body 10, operating handle 12, shaft 16, limit pin 18 and remote override assembly. Torsion spring 20 tends to rotate operating handle 12, limit pin 14, and associated shaft 16 in a counterclockwise direction (relative to FIG. 1), thereby tending to maintain limit pin 14 in the run position.

Figure 3:
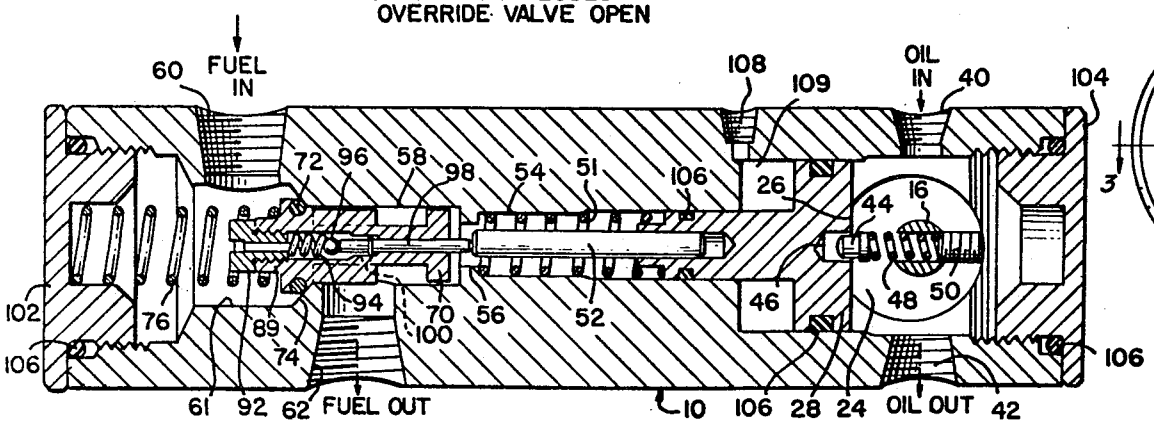
FIG. 3 is a cross-section taken along line 3—3 of FIG. 2 and showing the main valve of the present invention in a closed position.

FIG. 3 shows a cross sectional view along lines 3—3 of FIG. 2. Shaft 16 connects to an eccentric cam 24 having a flat 26 on one side thereof. Cam 24 functions as an override actuator by flat 26 displacing piston 28. The cam 24 will be in an override state when flat 26 is against piston 28 and on off or run state when cam 24 has flat 26 180° away from piston 28. Spring biased piston 28 serves as an lubricant pressure sensor to sense the oil pressure of the engine by way of oil inlet port 40 and oil outlet port 42. With the exception of the remote override cap 30C, those parts of the present invention discussed above operate in the same manner as the corresponding parts in the above-identified patents. When operating handle 12 is turned clockwise to be in the position in FIG. 1, cam 24 will raise spring-biased piston 28 to effectuate an override function. Flat side 26 of eccentric cam 24 will face piston 28 as shown in FIG. 3. However, once the lubricant oil pressure sufficiently overcomes the force of piston spring 51, cam 24 will be free to move relative to piston 28. Accordingly, torsion spring 20 will cause shaft 16 and attached cam 24 to rotate 180° from the piston shown in FIG. 3. In other words, cam 24, shaft 16, limit pin 14, and operating handle 12 will automatically reset themselves into a run mode. This automatic resetting feature is highly desirable in that there is no further need for the engine protective device to cutoff or limit fuel flow once the oil level pressure has attained a safe value.

Override Lock

Continuing to view FIG. 3, but also considering the side exploded view of FIG. 5, the override lock feature of the present invention will be presently discussed. It will be recalled briefly that an unscrupulous operator using one of the prior art engine protective devices may abuse the override mode. That is, such an operator may shift into an override mode, drive the engine for many miles, thereby causing extensive engine damage. Since the override feature is designed to simply allow an engine operator to get his truck or other machine to a safe place, this override abuse is especially troublesome to the engine owner. However, there was nothing in the prior art devices to prevent the unscrupulous operator from simply shifting the handle 12 180° counter clockwise from the position shown in FIG. 1, after which the operator could simply deny having used the override mode.

In order to prevent such abuse of the override feature, whereby the operator could simply deny having used the override, the cam 24 of the present invention has been greatly improved from the prior art. Specifically, the cam 24 includes a bore 43 which extends across a diameter of cam 24 to about the middle of flat 26. At that end of bore 43, extending through flat 26, there is included an annular land 45. Shaft 16 which is secured to cam 24 includes a bore lined up with the bore 43. A spring plunger 44 is placed in bore 43 from that side of bore 43 opposite flat 26. Annular land 45 will hold spring plunger 44 in bore 43 against the urging of spring 48 which is placed behind spring plunger 44. A screw 50 may be used to close that side of bore 43 opposite side 26. Additionally, screw 50 may serve as a set screw to secure cam 24 to shaft 16.

With reference to FIG. 3, piston 28 is unlike the prior art pistons in that it includes a catch hole 46 which cooperates with spring plunger 44. As shown in FIG. 3, the cam 24 is in an override position whereby spring plunger 44 is disposed within catch hole 46 of spring piston 28. Accordingly, cam 24 is locked in the override position such that an unscrupulous engine operator is prevented from turning handle 12 back to the run position. At the same time, the automatic resetting function described in the prior art is still operational. Specifically, once the oil pressure has moved piston 28 to the left in FIG. 3, spring plunger 44 will clear catch hole 46, thereby allowing torison spring 20 to automatically reset cam 24 in the same essential manner as the above patents. In the absence of oil pressure sufficient to reset cam 24, handle 12 will be locked in the override position, thus indicating to the engine owner that the operator has resorted to the override.

Main Valve and Override Valve

Viewing FIGS. 3, 4 and 6, the main valve and override valve of the present invention will be discussed in detail. Push rod 52, serving as a main valve operator, is secured to piston 28 and extends axially along cylindrical bore 54. Coil compression spring 51 is disposed around push rod 52 between piston 28 and annular land 56, thereby biasing piston 28 to the right (as viewed in FIG. 3).

Colinear with bore 54 is a cylindrical main valve bore 58 which is separated from bore 54 by annular land 56. Main valve bore 58 is disposed partly between fuel inlet port 60 and associated fuel chamber 61 on one side and fuel outlet port 62 on the other side. Disposed in main valve bore 58 is an elongated main valve member 70 which is normally closed by virtue of O-ring 72 being biased against annular valve seat 74 by main valve spring 76. Main valve member 70 includes flutes or grooves 78 extending axially along generally cylindrical main valve member 70, each of these axial grooves 78 being between two adjacent radially projecting portions 80. The axial grooves and associated radial portions 80 extend from a disc shaped portion 82 to a cylindrical portion 86 (best shown in FIG. 6). Radially projecting portions 88 are colinear with corresponding projecting portions 80. Disposed between the disc 82 and an outer disc 84 is the O-ring 72. Outer disc 84 operates as an annular fluid blocking portion in conjuction with O-ring 72 and valve seat 74. The fuel inlet end of main valve member 70 includes a screw accepting head portion 89 which is disposed within fuel inlet chamber 61. An axial bore 90 extends along the axis of main valve 70.

If desired, a slightly different structure than shown in the figures could be used for annular portion 84 and O-ring 72. Specifically, the O-ring 72 may be molded at the same time as the molding of the aluminum used for main valve member 70 and/or glued to member 70 to insure a strong seal therebetween. Further, the annular portion 84, O-ring 72, and valve seat 74 could be configured to provide metal-to-metal contact upon the spring 76 forcing the portion 84 towards the valve seat 74 with greater than a predetermined amounted of force. This alternate construction may be desired to maintain the effective seal of the O-ring 72 depending upon the force of spring 76.

The override valve parts which are generally within main valve member 70 will presently be discussed with reference to FIG. 3, FIG. 6 and FIG. 7 which shows an enlarged partial view in cross section of the parts inside one end of valve member 70. An override push rod 98 is disposed within axial bore 90 and extends out of main valve 70 to contact push rod 52. Touching the opposite end of the override push rod 98 is a override ball valve 96 which is biased towards 98 by override or a ball valve spring 94 which is disposed within main valve member 70. Push rod 98 is secured against being pushed out of the end of main valve member 70 by cooperation between stop ring 99 on override push rod 98 at annular recess 99R and the inwardly projecting annular stop 99S on bore 58. Screw 92 with axial orifice 93 (colinear with axial bore 90) is threadenly engaged to head portion 89 of main valve member 70, whereby override spring 94 override ball valve 96, and override push rod 98 are secured within bore 90.

The operation of the main valve member 70 and associated components will presently be discussed with reference to FIGS. 3, 4, 6 and 7 when operating handle 12 is disposed in the normal run mode. The absence of sufficient oil pressure acting on lubricant pressure sensing spring biased piston 28 will allow main valve spring 76 to bias main valve member 70 such that O-ring 72 is seated against main valve seat 74 as shown in FIG. 3. This cuts off any fuel flow from fuel inlet port 60 to fuel outlet port 62 by way of the main fuel passageway including fuel chamber 61 and that portion of bore 58 to the left (FIG. 3) of fuel outlet port 62. In addition to the main valve being closed in FIG. 3, the override valve 96 will be closed as shown in FIG. 7 as long as operating handle 12 is not moved from the run position. In this run position, the flat 26 of cam 24 will be 180° removed from piston 28. Override push rod 98 will be in its furthest right position as shown in FIG. 7 with annular stop ring 99 disposed next to associated inwardly projecting angular stop 99S on bore 90. Accordingly, ball valve 96 will be biased by override or ball valve spring 94 to seat against annular ball valve seat 96S. When the ball valve 96 is seated against ball valve seat 96S, no fuel may flow from fuel inlet port 60 to fuel outlet port 62 by way of axial orifice 93 (in screw 92), axial bore 90 and restricted outlet ports 100, a plurality of which are disposed within the axial grooves 78 of main valve member 70 (see especially FIG. 6). The restricted outlet ports 100 communicate with that portion of bore 90 downstream from ball 96. Accordingly, in the valve position shown in FIG. 7, fuel will be completely cut off from the engine.

It will thus be seen that the main valve will be closed when lubricant pressure sensing piston 28 indicates that the oil pressure is below a predetermined value P1. Push rod 52 serves as a main valve operator which maintains the main valve open as long as the oil pressure on the piston is above P1. Momentarily referring back to the override lock, it should be appreciated that spring plunger 44 locks cam 24 until oil pressure displaces piston 28 sufficiently for plunger 28 to clear hole 46. This would occur at pressure value P2 which is not necessarily the same value as P1, although it will preferably be quite close.

In order to override the engine cutoff feature by allowing a restricted amount of fuel to flow to the engine, the override handle 12 will be rotated 180° clockwise so as to be in a position shown in FIG. 1. Upon this rotation cam 24 will also rotate 180° such that flat 26 will now be disposed in contact with the face of piston 28 as shown in FIG. 3. As cam 24 is rotated, piston 28 will ride to the left (view of FIG. 3) such that push rod 52 will displace override push rod 98 to the left. The displacement of override push rod 98 to the left and away from lubricant-pressure sensing piston 28 will cause ball valve 96 to be displaced to the left and away from ball valve seat 96S. Accordingly, a small or restricted amount of fuel may now flow from fuel inlet port 60 to fuel outlet port 62 by way of axial orifice or bore inlet 93, axial bore 90, and restricted fuel bore outlet 100. At the same time, the displacement in piston 28 caused by rotation of cam 24 will be insufficient to cause push rod 52 to displace leftwardly main valve member 70. Thus, O-ring 72 will remain seated against main valve seat 74 as shown in FIG. 3.

As is discussed in detail above, the spring plunger 44 will catch onto catch hole 46 in piston 28, whereby the engine operator will not be able to rotate cam 24, shaft 16 and attached handle 12 back to the run position. However, upon the correction of the insufficient oil pressure, piston 28 will be displaced further leftwardly from the position shown in FIG. 3 whereby torsion spring 20 will automatically reset manual override handle 12. Additionally, the displacement leftwards of piston 28 will cause push rod 52 to further compress spring 94 using up the play in override push rod 98 such that push rod 52 is not in contact with the end of valve member 70. Accordingly, valve member 70 will be displaced leftward, the main valve opening by virtue of O-ring 72 being unseated from valve seat 74 as shown in FIG. 4. Fuel may then proceed from fuel inlet port 60 to fuel outlet port 62 by way of flutes or axial grooves 78 in main valve 70, the main valve being disposed in an open position for normal engine operation.

In addition to being particularly advantageous in using push rod 52 and piston 28 to open both the main valve and the override valve, the present arrangement is especially advantageous in providing the engine owner with the option of using a full engine cutoff capability or a detorque upon inadequate oil pressure. Specifically, the arrangement shown in FIG. 3 may be easily converted into a detorque safety device by first unthreading end cap 102. Next, screw 92 may be removed from main valve member 70. Override push rod 98, ball valve 96 and spring 94 may then be removed from axial bore 90 in main valve member 70. Screw 92 and fuel end cap 102 may then be threaded back into their previous positions with spring 76 biasing main valve member 70, main valve 70 will provide its usual main valve functions in addition to providing a detorque or restricted fuel flow by way of orifice 93, axial bore 90 and restricted fuel outlet ports 100.

Although the option of using the device in either a full cutoff or a detorque mode is somewhat similar to that shown in prior art U.S. Pat. No. 3,590,798, the present invention provides that option with safeguards not realizable in that prior art patent. Specifically, although the present invention provides for a convenient adaptation from a cutoff to a detorque operation, the adaptation is internal to main body 10. It is therefore less likely to be tampered with by an operator who wishes to overrule the directions of the engine owner.

Opposite fuel end cap 102 is an oil end cap 104 which threads to body 10. Additionally, O-ring gaskets 106 are disposed in various locations within the safety device. A threaded hole 108 (FIG. 3) is used to accommodate a felt filter, allowing chamber 109 to "breathe" as piston 28 rides back and forth.

Remote Override Fuction

Figure 8:
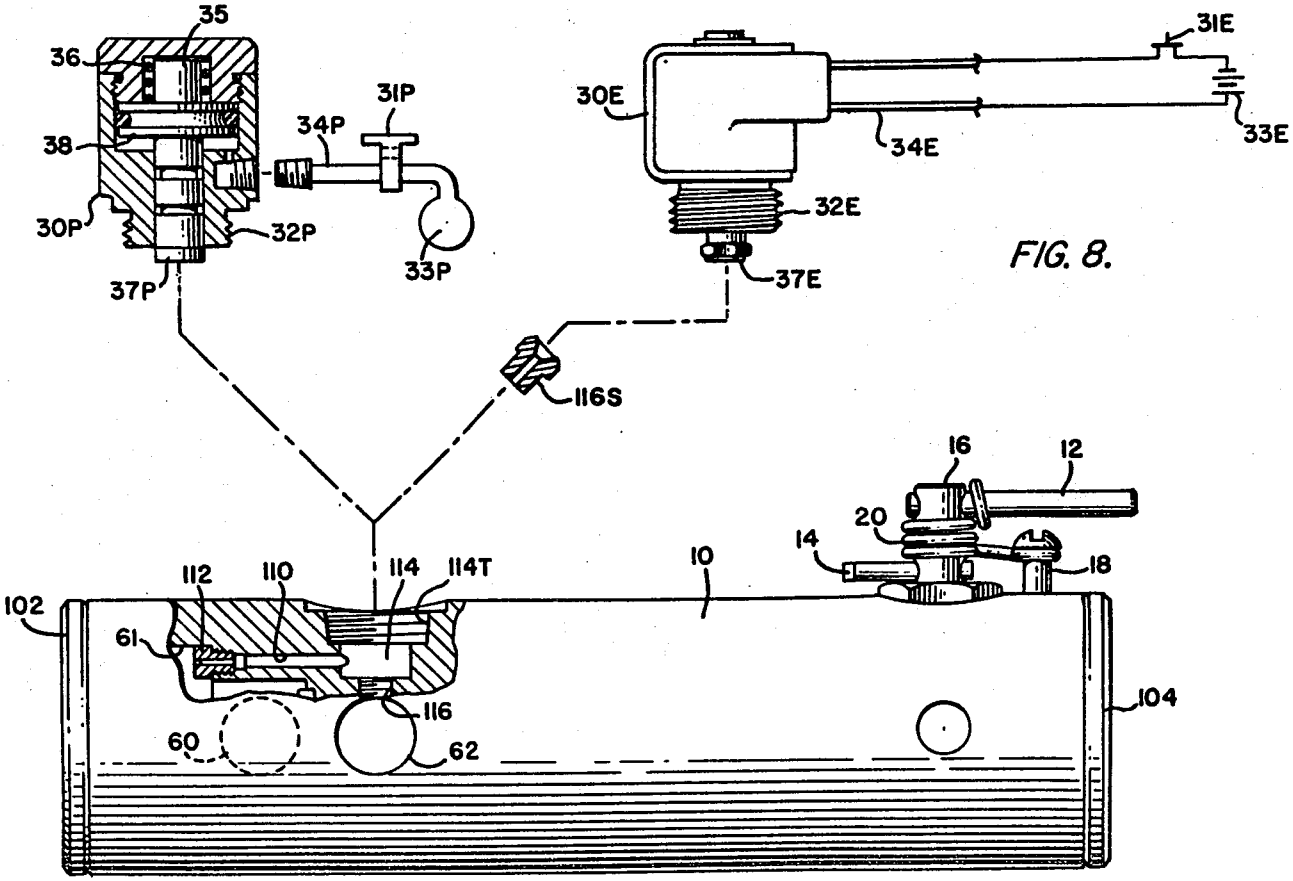
FIG. 8 is a side view of parts of the present invention, shown in partial cross section to reveal the remote override feature, and showing both pneumatic and electrical embodiments of a remotely actuated valve.

Referring now to FIG. 8, the remote override or bypass valve feature of the present invention will be discussed. Specifically, there is shown in FIG. 8 side view of main body 10 showing a partial cross section of a remotely actuated override portion. In particular fuel inlet chamber 61 is in communication with bypass fuel passageway 110 by way of an axial orifice in screw 112. Fuel bypass passageway 110 extends into a remote override chamber 114 having a threaded opening 116 extending into fuel outlet port 62 (shown in phantom in FIG. 8). Remote override changer 114 includes a threaded mouth 114T for accommodating a remote override assembly.

Threads 32P on pneumatic override assembly 30P, functioning as a bypass valve, are adapted to engage the threads 114T of remote override changer 114. A spring 36 normally biases rod 35 and attached piston 38 downwardly such that valve portion 37P of rod 35 will normally close off any fuel flow which might otherwise go through port 116. However, upon the application of pneumatic pressure to pneumatic override assembly 30P by way of pneumatic control line 34P from pneumatic source 33P through momentary push-button valve 31P, piston 38 and valve portion 37P will be displaced upwardly such that fuel may fully flow from bypass fuel passageway 110, through port 116, and into fuel outlet port 62.

As an alternate embodiment, the override assembly bypass valve of the present invention may be realized by an electrical override assembly 30E having threads 32E to cooperate with threads 114T. Control line or lines 34E may extend from the electrical override assembly 30E to a remote electrical switch 31E. The electrical override assembly 30E, screw 116S is threaded into opening 116 to provide a proper valve seat. For electrical override assembly 30E may be realized by a conventional solenoid which selectively blocks and opens the orifice in screw 116S by valving portion 37E. Preferably, electrical override 37E is a solenoid valve of the normally closed type such that 37E will block fuel flow bypass fuel passageway 110 in the absence of an electrical signal on electric cable 34E.

The remote override assemblies 30P and 30E are especially useful in starting an engine having the present safety device attached thereto. Turning back momentarily to FIG. 3, it will be apparent that main valve O-ring, 72 will be seated against valve seat 74 in the absence of sufficient oil pressure to properly displace piston 28. For many engines this does not pose a problem because there is sufficient fuel downstream of main valve member 70 to allow initial start up, whereupon oil pressure will quickly build up to open valve member 70. However, for some engines the oil pressure will not build up sufficiently quickly to properly open valve member 70. Accordingly, the remote override may be actuated to allow engine start-up until the oil pressure is high enough to open valve member 70.

In order to minimize the possibility of remote override abuse, the pneumatic valve override assembly 30P is preferably controlled by a panel mounted press-to-hold push botton valve 31P. Likewise, the electrical solenoid valve override assembly 30E is preferably controlled by a panel mounted press to hold pushbutton 31E. Accordingly, the remote override function on these embodiments will be realized only as long as the engine operator depresses the push to hold pushbutton, either electrical or pneumatic.

The body 10 of the present fuel controller is especially flexible in that the pneumatic override assembly 30P and the electrical override assembly 30E are completely interchangeable. For an engine starting by an air starter, the pneumatic override assembly 30P would be preferred. For an engine, wherein the common method of engine starting is accomplished by a battery or electrical starting, the present fuel controller will effectuate a remote override function by virtue of electrical override assembly 30E. If an engine owner initially equips his fuel controller for a pneumatic remotely actuated override function, he can easily convert to an electrical remotely actuated override function simply by substituting 30E for 30P. Likewise, an owner can easily change from an electrical remote override function to a pneumatic override function. Additionally, should the engine owner so desire, no remote override function need be provided. In particular, a cap plug 30C (shown in FIG. 1 and FIG. 2) may be threaded into chamber 114 instead of either of the override assemblies 30P and 30E. The cap plug 30C may simply provide a continuous block to the orifice in screw 116S, whereby bypass fuel passageway 110 is always closed.

Independent Remote Override

Figure 9:
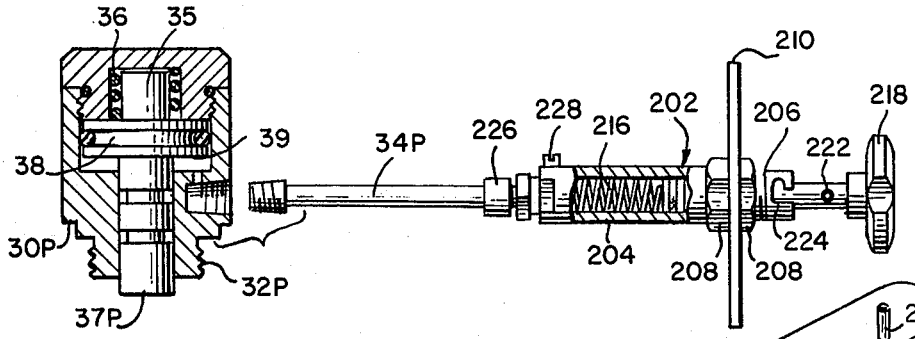
FIG. 9 is a side view of an improved remote override arrangement.
Figure 10:
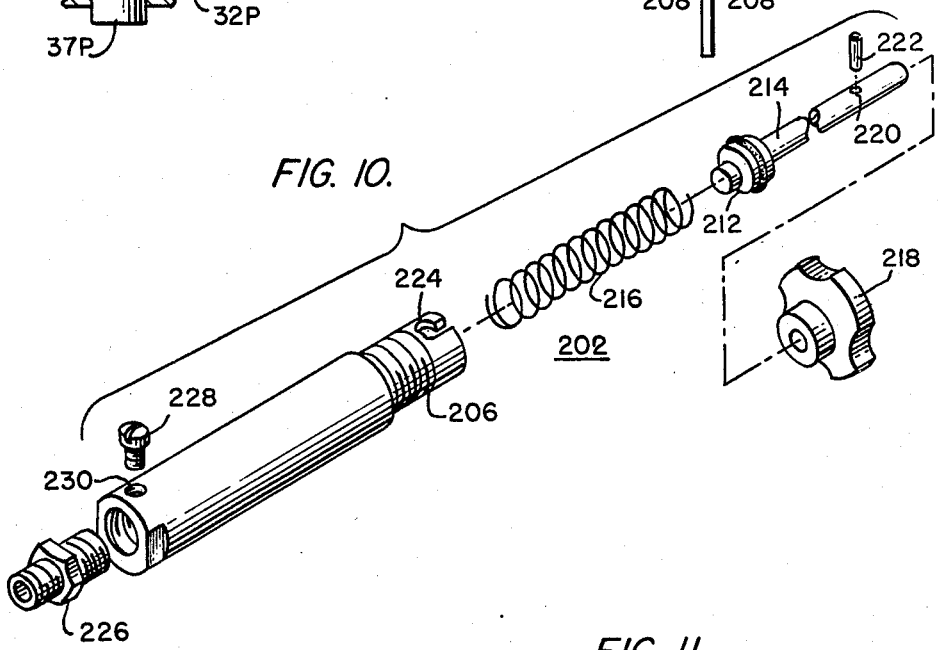
FIG. 10 shows a perspective exploded view of the FIG. 9 remote override.

Turning now to FIGS. 9 and 10, an improved remote override will be discussed in detail. This override activation control operates with the pneumatic override assembly 30P previously discussed with respect to FIG. 8, but also included in the side view of FIG. 9. As with the pneumatic control system of FIG. 8, the pneumatic control of FIG. 9 uses a pressurized fluid control line 34P to actuate the piston 38. Specifically, the piston 38 is rigidly connected to the valving member 37P and includes a pressure responsive bypass surface 39.

The improved remote override 202 shown in FIGS. 9 and 10 includes a hydraulic cylinder 204 including a threaded sleeve portion 206. Nuts 208 may be screwed onto the sleeve 206 to mount the device 202 to a panel 210 (FIG. 9 only). The panel 210, shown in partial break-away, may be a dashboard panel upon a diesel vehicle.

Extending into the hydraulic cylinder 204 is a hydraulic piston 212 and associated shaft 214. A spring 216 biases the piston 212 and the attached shaft 214 out from the panel 210. A pushbutton 218 is fixed to an end of the shaft 214 opposite the piston 212.

A hole 220 is disposed in the shaft 214. An optional locking pin 222 may be fixed into the hole 220. The locking pin 222 is adapted to cooperate with a locking notch 224 disposed on the threaded sleeve 206.

A fitting 226 is used at one end of the hydraulic cylinder 204 to connect to the pressurized fluid control line 34P. A bleed screw 228 is disposed in hole 230 in the hydraulic cylinder 204.

The operation of the remote override or bypass valve actuator 202 of FIGS. 9 and 10 is relatively straight forward. Unlike the remote override relying upon the pneumatic air source 33P in FIG. 8, the device 202 uses hydraulic fluid to actuate the piston 38. Specifically, the control line 34P and that portion of hydraulic cylinder 204 with spring 216 is filled with hydraulic fluid. Brake fluid may preferrably be used. Depending upon the length of the control line 34P, differing mixtures of the brake fluid and air should be used. For example, if the control line 34P is approximately 16 feet about 95% brake fluid and 5% air should be used. If the control line is only 5 or 6 feet long, about ⅔ brake fluid should be used. By using the combination of brake fluid and air one can adapt the palm operated pushbutton 218 for the right amount of travel. Obviously, if the control line and hydraulic cylinder were filled completely with hydraulic fluid the travel of the pushbutton 218 would be extremely slight due to the relative incompressability of hydraulic fluid. Conversely, if too much air is used, the maximum of travel on the pushbutton 218 might not place sufficient pressure on the piston 38 to open the bypass or remote override valve. The bleed screw 228 may be used to control the mixture of air and hydraulic fluid in a manner well known in the art.

When the pushbutton 218 is depressed, the hydraulic piston 212 compresses the spring 216 and pressurizes the control fluid including air and hydraulic liquid within control line 34P. The compression of this fluid places pressure on the piston 38 by way of its pressure responsive surface 39. The piston 38 compresses the spring 36 and moves the valving portion 37P to open the bypass fuel passageway 110 (shown in FIG. 8 only).

Figure 11:
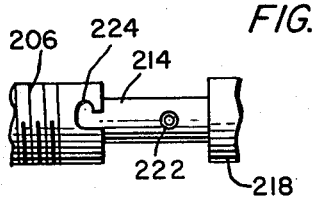
FIGS. 11 and 12 are side views in partial break-away to illustrate the lock-in option with the remote override of FIG. 9.
Figure 12:
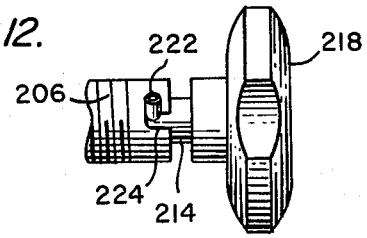

The locking pin 222 may be used to secure the palm button 218 in a depressed position. Specificially, 222 may be pushed into the notch 224 (see especially FIGS. 11 and 12) and rotated into a locking position (FIG. 12) to thereby keep the bypass fuel passageway 110 (FIG. 8) open without the need to continuously depress pushbutton 218.

If the engine owner is concerned about the engine operator driving his vehicle or operating the engine for a long period of time after activation of the remote override, the locking pin 222 need not be included. Instead, a smaller pin may simply be used to cover hole 220. Alternately, the shaft 214 might simply not have the hole 220.

Considering again FIGS. 3 and 8, it will be noted that the bypass valve or remote override actuator 202 is used to control the bypass fuel passageway 110 which is at least partly outside of boundaries defining the main fuel passageway between fuel inlet port 60 and fuel outlet port 62.

An important feature of the remote override or bypass valve actuator 202 of FIGS. 9 and 10 is that it affects the internal combustion engine only by operation of the bypass valve including valve portion 37P. In other words, the pushbutton 218 of bypass valve actuator 202 does not control any function of the internal combustion engine, but instead only controls the valve portion 37P. Likewise, the bypass valve including bypass valve portion 37P and piston 38 is the only mechanism controlled by the pressurized fluid control line 34P. Accordingly, any leak in the control line 34P will not jeopardize the braking system of a vehicle as would be the case if the pressurized control line 34P relied upon fluid in the vehicle's braking system.

An advantageous feature of the remote override assembly 30P (FIGS. 8 and 9) and the override assembly 30E (FIG. 8) is that they are removably mounted to the main body 10 of the present apparatus. Accordingly, they may optionally be included in any system. At the same time, they do not take up space within the main body if they are unnecessary in a particular application. Instead, the cap 30C may simply to screwed into place as shown in FIG. 1.

The present invention causes the cutoff of fuel flow in response to an oil pressure drop. It is therefore useful in conjuction with devices which cause an oil pressure drop responsive to engine overheating, coolant loss, or other malfunctions. Such devices may, for example, be similar to those disclosed in U.S. Pat. Nos. 3,533,390, issued Oct. 13, 1970 and 3,877,455, issued Apr. 15, 1975, both invented by Joe E. Goodwin and assigned to the assignee of the present invention.

Although the present invention has been described in detail with respect to specific construction, arrangements, materials, these details for illustrative purposes only. Numerous modifications and adaptations will be readily apparent to those of ordinary skill in the art. Accordingly, the scope of the present invention will be determined by reference to the appended claims.

I claim:

1. An apparatus for controlling the flow of fuel in a fuel supply line of an internal combustion engine in response to pressure in the engine's lubricating system and comprising:

(a) a main body having a main fuel passageway therein:

(b) a fuel inlet port and a fuel outlet port, each port communicating with said main fuel passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1;

(e) a bypass fuel passageway in said main body, bypassing that portion of said main fuel passageway controlled by said main valve, and operable to allow a predetermined restricted amount of fuel to flow from said fuel inlet port to said fuel outlet port;

(f) a normally closed bypass valve selectively blocking said bypass fuel passageway; and (g) a bypass valve actuator remote from said main body and controlling said bypass valve by a pressurized fluid control line; and wherein said bypass fuel passageway is at least partly outside of boundaries which define said main fuel passageway, and wherein said bypass valve actuator includes a spring-biased actuating piston operable to place fluid in said control line under pressure, and said bypass valve is operated by a spring-biased bypass piston disposed at least partly outside said main body, and wherein said actuating piston is operable to open said bypass valve by moving said bypass piston.

2. The apparatus of claim 1 further comprising an override actuator mounted on said main body at least partly externally to said main body and selectively disposable in an off state and in an override state, said override state allowing fuel flow from said fuel inlet port to said fuel outlet port even if the pressure in the engine's lubricating system is below said predetermined value P1.

3. The apparatus of claim 1 wherein said bypass valve is moved by movement of a bypass piston rigidly connected to said bypass valve.

4. The apparatus of claim 1 wherein said bypass valve actuator includes a manually-operable push button and said bypass valve will be open only as long as said push button is pressed.

5. An apparatus for controlling the flow of fuel in a fuel supply line of an internal combustion engine in response to pressure in the engine's lubricating system and comprising:

(a) a main body having a main fuel passageway therein;

(b) a fuel inlet port and a fuel outlet port, each port communicating with said main fuel passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1;

(e) a bypass fuel passageway in said body, bypassing that portion of said main fuel passageway controlled by said main valve, and operable to allow a predetermined restricted amount of fuel to flow from said fuel inlet port to said fuel outlet port;

(f) a normally closed bypass valve selectively blocking said bypass fuel passageway; and (g) a bypass valve actuator remote from said main body and controlling said bypass valve by a pressurized fluid control line; and wherein said bypass fuel passageway is at least partly outside of boundaries which define said main fuel passageway, and wherein said bypass valve actuator includes a manually-operable pushbutton and means for locking said pushbutton in an on position corresponding to said bypass valve being open.

6. The apparatus of claim 5 wherein said pushbutton is mounted on a shaft disposed partly within a sleeve and said means for locking includes a locking pin on said shaft and a locking notch in said sleeve for receiving said locking pin and locking said pushbutton in an on position.

7. An apparatus for controlling the flow of fuel in a fuel supply line of an internal combustion engine in response to pressure in the engine's lubricating system comprising:

(a) a main body having a main fuel passageway therein;

(b) a fuel inlet port and a fuel outlet port, each port communicating with said main fuel passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1;

(e) a bypass fuel passageway in said main body, bypassing that portion of said main fuel passageway controlled by said main valve, to allow a predetermined restricted amount of fuel to flow from said fuel inlet port to said fuel outlet port;

(f) a normally closed bypass valve selectively blocking said bypass fuel passageway; and (g) a bypass valve actuator remote from said main body and controlling said bypass valve by a pressurized fluid control line, said bypass valve actuator including a spring-biased actuating piston operable to place fluid in said control line under pressure, and wherein said bypass valve actuator affects the internal combustion engine only by operation of said bypass valve, and wherein said bypass valve is the only mechanism controlled by the pressurized fluid control line.

8. The apparatus of claim 7 further comprising a pressure-responsive bypass surface rigidly controlled to said bypass valve and in contact with pressurized fluid from said control line.

9. The apparatus of claim 8 wherein said bypass valve actuator includes a manually-operable pushbutton and said bypass valve will be open only as long as said pushbutton is pressed.

10. The apparatus of claim 8 wherein said bypass valve actuator includes a manually-operable pushbutton and means for locking said pushbutton in an on position corresponding to said bypass valve being open.

11. The apparatus of claim 8 wherein said pressure-responsive bypass surface is external to said main body.

12. An apparatus for controlling the flow of fuel in a fuel supply line of an internal combustion engine in response to pressure in the engine's lubricating system, comprising:

(a) a main body having a main fuel passageway therein;

(b) a fuel inlet port and a fuel outlet port, each port communicating with said passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1;

(e) a bypass fuel passageway in said main body, bypassing that portion of said main fuel passageway controlled by said main valve, to allow a predetermined restricted amount of fuel to flow from said fuel inlet port to said fuel outlet port;

(f) a normally closed bypass valve selectively blocking said bypass fuel passageway; and (g) a bypass valve actuator remote from said main body and controlling said bypass valve by a control line; and wherein said bypass valve is part of a remote override assembly removably mounted to said main body and having a portion external to said main body, and wherein said bypass valve actuator includes a manually-operable pushbutton and means for locking said pushbutton in an on position corresponding to said bypass valve being open.

13. The apparatus of claim 12 further comprising a pressure-responsive bypass surface rigidly connected to said bypass valve and in contact with pressurized fluid from said control line.

14. The apparatus of claim 12 further comprising an override actuator mounted on said main body at least partly externally to said main body and selectively disposable in on off state and in an override state, said override state allowing fuel flow from said fuel inlet port to said fuel outlet port even if the pressure in the engine's lubricating system is below said predetermined value P1.

15. The apparatus of claim 14 further comprising an override lock operable to prevent the changing of said override actuator from the override state to the off state if the pressure in the engine's lubricating system is below a predetermined value P2.

16. An apparatus for controlling the flow of fuel in a fuel supply line of an internal combustion engine in response to pressure in the engine's lubricating system comprising:

(a) a main body having a main fuel passageway therein;

(b) a fuel inlet port and a fuel outlet port, each port communicating with said main fuel passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1, said main valve includes an elongate movable main valve member which is spring-biased by a main valve spring to be normally closed, said main valve member including a bore therein, said bore having a bore inlet in communication with said fuel inlet port and a bore outlet in communication with said fuel outlet port such that fuel may flow through said bore from said fuel inlet port to said fuel outlet port;

(e) an override push rod disposed at least partially in said bore;

(f) an override actuator selectively disposable in an off state and an override state, said override state allowing fuel flow in the fuel supply line of the engine even if the pressure in the engine's lubricating system is below a predetermined value P1; and wherein said override actuator is operable in its override state to allow fuel flow from said bore inlet to said bore outlet by moving said override push rod away from said lubricant pressure sensor, and (g) a bypass fuel passageway in said body, bypassing that portion of said main fuel passageway controlled by said main valve, and operable to allow a predetermined restricted amount of fuel to flow from said fuel inlet port to said fuel outlet port;

(h) a normally closed bypass valve selectively blocking said bypass fuel passageway;

(i) a bypass valve actuator remote from said main body and controlling said bypass valve by a pressurized fluid control line; and (j) a pressure-responsive bypass surface rigidly connected to said bypass valve and in contact with pressurized fluid from said control line; and wherein said bypass valve actuator includes a spring-biased actuating piston operable to place fluid in said control line under pressure.

17. The apparatus of claim 16 wherein said override actuator is mounted on said main body at least partly externally thereto.

18. The apparatus of claim 16 further including a spring-biased ball valve inside of said main valve member, said spring-biased ball valve selectively blocking said bore.

19. An apparatus for controlling the flow of fuel in a fuel supply line of an internal combustion engine in response to pressure in the engine's lubricating system, comprising:

(a) a main body having a main fuel passageway therein;

(b) a fuel inlet port and a fuel outlet port, each port communicating with said main fuel passageway and adapted to be connected to the fuel supply line of an internal combustion engine;

(c) a lubricant pressure sensor for sensing the pressure in the engine's lubricating system;

(d) a main valve in said main fuel passageway for controlling the normal flow of fuel between said fuel inlet port and said fuel outlet port, said main valve closing when the lubricant pressure sensor indicates that the pressure in the engine's lubricating system is below a predetermined value P1, said main valve includes an elongate movable main valve member which is spring-biased by a main valve spring to be normally closed, said main valve member including a bore therein, said bore having a bore inlet in communication with said fuel inlet port and a bore outlet in communication with said fuel outlet port such that fuel may flow through said bore from said fuel inlet port to said fuel outlet port;

(e) an override valve disposed in said bore;

(f) an override spring disposed at least partially within said main valve member and biasing said override valve;

(g) an override actuator selectively disposable in an off state and an override state, said override state allowing fuel flow in the fuel supply line of the engine even if the pressure in the engine's lubricating system is below said predetermined value P1; and wherein said override actuator is operable in its override state to allow fuel flow from said bore inlet to said bore outlet by moving said override valve against the bias of said override spring;

(h) a bypass fuel passageway in said body, bypassing that portion of said main fuel passageway controlled by said main valve, and operable to allow a predetermined restricted amount of fuel to flow from said fuel inlet port to said fuel outlet port;

(i) a normally closed bypass valve selectively blocking said bypass fuel passageway; and (j) a bypass valve actuator remote from said main body and controlling said bypass valve by a pressurized fluid control line; and wherein said bypass valve actuator includes a spring-biased actuating piston operable to place fluid in said control line under pressure.

20. The apparatus of claim 19 wherein said override valve is a ball valve within said bore.

21. The apparatus of claim 19 wherein said bypass valve actuator includes a manually-operable pushbutton and means for locking said pushbutton in an on position corresponding to said bypass valve being open.

* * * * *